US009840308B2

(12) United States Patent
Frabetti

(10) Patent No.: US 9,840,308 B2
(45) Date of Patent: Dec. 12, 2017

(54) BOAT WITH STERN HATCH WITH INTEGRATED MOVEMENT

(71) Applicant: FERRETTI S.P.A., Cattolica (IT)

(72) Inventor: Andrea Frabetti, Zola Predosa (IT)

( * ) Notice: Subject to any disclaimer, the term of this patent is extended or adjusted under 35 U.S.C. 154(b) by 0 days.

(21) Appl. No.: 15/122,096

(22) PCT Filed: Mar. 3, 2015

(86) PCT No.: PCT/IB2015/051540

§ 371 (c)(1),
(2) Date: Aug. 26, 2016

(87) PCT Pub. No.: WO2015/132721

PCT Pub. Date: Sep. 11, 2015

(65) Prior Publication Data

US 2017/0015389 A1 Jan. 19, 2017

(30) Foreign Application Priority Data

Mar. 5, 2014 (IT) ..... MI2014A0336

(51) Int. Cl.

| | |
|---|---|
| ***B63B 19/16*** | (2006.01) |
| ***B63B 19/12*** | (2006.01) |
| ***B63B 19/08*** | (2006.01) |
| ***B63B 27/14*** | (2006.01) |
| ***B63B 19/28*** | (2006.01) |
| *B63B 29/04* | (2006.01) |

(52) U.S. Cl.

CPC ..... *B63B 19/12* (2013.01); *B63B 19/08* (2013.01); *B63B 19/28* (2013.01); *B63B 27/143* (2013.01);

(Continued)

(58) Field of Classification Search

CPC . B63B 19/08; B63B 2019/0053; B63B 19/00; B63B 19/12; B63B 19/19;

(Continued)

(56) References Cited

U.S. PATENT DOCUMENTS 4,953,492 A * 9/1990 Duffty ..... B60F 3/0007 114/282
5,579,711 A * 12/1996 Thomas ..... B63B 39/061 114/285

(Continued)

FOREIGN PATENT DOCUMENTS

DE 4209090 A1 10/1992
EP 1122164 A2 8/2001

(Continued)

OTHER PUBLICATIONS

International Search Report and Written Opinion dated Jun. 18, 2015 for PCT/IB2015/051550 to Ferretti S.P.A. filed Mar. 3, 2015.

*Primary Examiner* — Daniel V Venne

(74) *Attorney, Agent, or Firm* — Vorys, Sater, Seymour and Pease LLP

(57) ABSTRACT

A boat includes a hull provided with a rear stern hatch located in correspondence with an internal stern compartment of the hull and suitable for opening and closing in correspondence with an aperture of the compartment, the hatch having a body with opposed side located in correspondence with side walls of the compartment and a upper edge and a lower edge. The hatch includes an actuator to open and close the compartment arranged inside its own body. The actuator rotatably constraining at least one of the sides of the hatch to the hull. The body being not provided with any further connections of the sides to the hull.

14 Claims, 9 Drawing Sheets

(52) U.S. Cl.
CPC ... *B63B 2019/086* (2013.01); *B63B 2029/043* (2013.01)

(58) Field of Classification Search
CPC . B63B 19/28; B63B 2019/00; B63B 2019/08; B63B 2019/086; B63B 2019/12; B63B 2019/14; B63B 27/00; B63B 27/14; B63B 27/143; B63B 2027/00; B63B 2027/14
USPC ..... 114/116, 117, 201 R, 203, 343, 362, 364
See application file for complete search history.

(56) References Cited

U.S. PATENT DOCUMENTS

| | | | | |
|---|---|---|---|---|
| 6,792,886 | B1 * | 9/2004 | Maloney | B63B 1/06 114/60 |
| 9,168,981 | B2 | 10/2015 | Ferretti | |
| 9,592,887 | B2 | 3/2017 | Frabetti | |
| 2002/0134290 | A1 * | 9/2002 | Armour | B63B 27/00 114/72 |
| 2006/0075952 | A1 | 4/2006 | Grimaldi | |
| 2010/0288179 | A1 | 11/2010 | Grimaldi | |
| 2013/0220207 | A1 | 8/2013 | Mueller | |
| 2017/0066510 | A1 | 3/2017 | Frabetti | |

FOREIGN PATENT DOCUMENTS

| | | | |
|---|---|---|---|
| EP | 2305553 | A1 | 4/2011 |
| EP | 2332820 | A1 | 6/2011 |
| FR | 2862273 | A1 | 5/2005 |
| WO | 2008135807 | A1 | 11/2008 |
| WO | 2011137548 | A2 | 11/2011 |
| WO | 2015132721 | A1 | 9/2015 |

* cited by examiner

BOAT WITH STERN HATCH WITH INTEGRATED MOVEMENT

CROSS-REFERENCE TO RELATED APPLICATIONS

This is a §371 National Stage Application of International Application No. PCT/IB2015/051540 filed on Mar. 3, 2015, claiming the priority of Italian Patent Application No. MI2014A000336 filed on Mar. 5, 2014.

FIELD OF THE INVENTION

The object of the present invention is a boat according to the preamble of the main claim. EP2305553 presents the characteristics of the invention described in said preamble.

BACKGROUND OF THE INVENTION

Boats having a stern compartment provided with at least one closing stern hatch of its own are known for a long time. Such a compartment is used, for instance, to house a small boat or a tender. It is also known that in the stern portion, many prestigious boats have a stern platform determined by a projecting plane suitable for operating as a "small beach" for the boat's passengers.

With reference to said hatch, it can be moved with the purpose of freeing or closing an aperture to access the stern compartment (from the sea or from the stern platform). For this purpose, actuating members are usually provided, usually in the form of telescopic members which constrain the body of the hatch to side walls of the stern compartment. This solution implies that, irrespective of whether the hatch is closed or open, such telescopic (pneumatic or hydraulic) members limit the internal space of the stern compartment. The hatch being open, conversely, they can be hitted against by those who occupy the craft, who might hurt themselves or in any case cause even non negligible physical damages to themselves.

Also, the presence of said telescopic actuating members makes the mounting of the hatch onto the aperture of the stern compartment a rather complex operation, in that it shall be performed through a number of successive steps, which include positioning the hatch and the actuating members locally, constraining the latter to the wall of the stern compartment and to the hatch body, and correctly adjusting the position of the latter with respect to the aperture of the stern compartment so as to allow an optimum closing.

Also add to this the fact that in the known solutions mentioned above the hatch and the walls of the compartment shall comprise hinge means and countermeans to allow the rotary motion (around said hinges) to open and close the hatch onto the compartment. Consequently, a need arises for associating hinge pins with the opposed sides of the hatch or with the walls of the compartment, such pins being suitable for being housed within seats provided for this purpose in said walls and sides. All of this requires non negligible times or difficulties, also considering that a hatch of the type under examination possibly features a surface of several square meters.

EP2305553, which forms the preamble of claim 1, describes a side service door for boats comprising shaped shutters applied at a boat compartment. Operation means are operatively connected to each shutter and are coupled with the hull of the boat; the above operation means are suitable to move each shutter between a rest position wherein the shutters close the compartment and a working position in which each shutter protrudes from the hull.

The operation means are externally located to each shutter at least when the shutter is in its working position.

SUMMARY OF THE INVENTION

The purpose of the present invention is to offer a boat that is enhanced with respect to the known boats.

Specifically, a purpose of the present invention is to offer a boat provided with a stern compartment on which a corresponding stern hatch not rigidly connected to the boat, is located.

More specifically, a purpose of the invention is to offer a boat provided with a stern compartment on an aperture of which a corresponding stern hatch is located which is moved by means that do not limit the amplitude of the compartment either when the hatch is closed or it is open.

Another purpose is to offer a boat of the type mentioned above, in which the hatch can be assembled onto the stern compartment with reduced times and costs with respect to those requested to assemble hatches onto their corresponding compartments in boats according to the present status of the art.

A further purpose is to offer a boat in which the hatch is not provided with any hinge means suitable for cooperating with their corresponding countermeans associated with the stern compartment, this allowing to reduce the costs and times necessary to assemble the hatch onto the boat.

A further purpose is to offer a boat in which one and the same hatch, if properly configured, can be alternatively hinged so as to open toward the stern platform and far away therefrom, being it possible to take said decision even at the last moment just upon finishing the craft.

A further purpose of the invention is to offer a boat in which one and the same stern hatch is capable of performing a dual function, i.e. closing the stern compartment and operating as a plane to stay on or rear small beach defined by a surface lacking in projecting members, said hatch being obviously movable so as to allow the opening of and the access to the stern compartment.

Another purpose is to offer a boat of the mentioned type in which the stern hatch can be used reliably in each of its positions assumed with respect to the craft.

These purposes and others which will be apparent to those expert in the art are achieved by a boat according to the attached claims.

BRIEF DESCRIPTION OF THE DRAWING

For a better understanding of the present invention the following drawings are attached for purely explanatory, not exhaustive, purposes, of which.

DETAILED DESCRIPTION OF THE PREFERRED EMBODIMENTS

Figure 1:
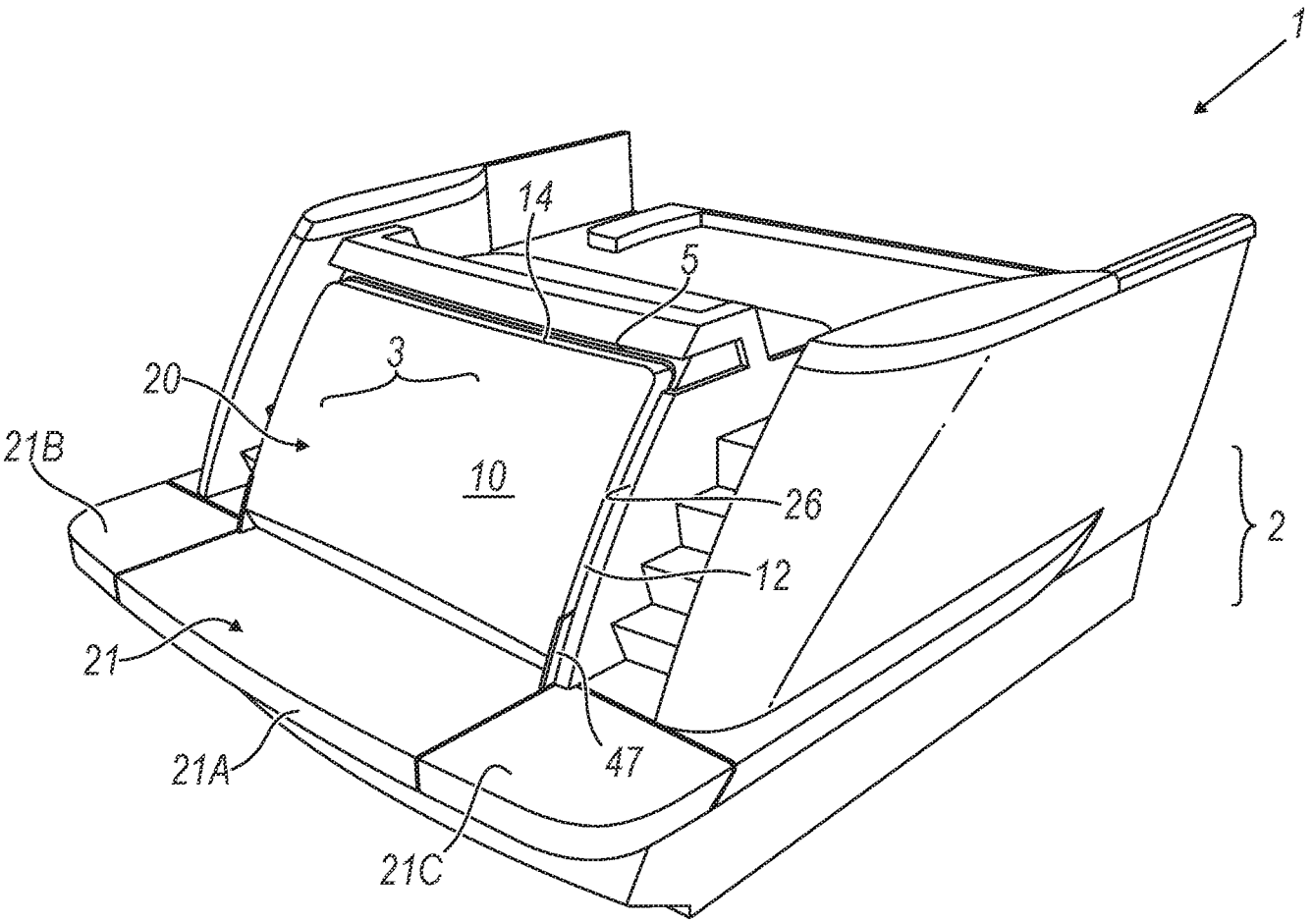
FIG. 1 shows the stern of a boat according to the invention, its stern hatch being closed.
Figure 2:
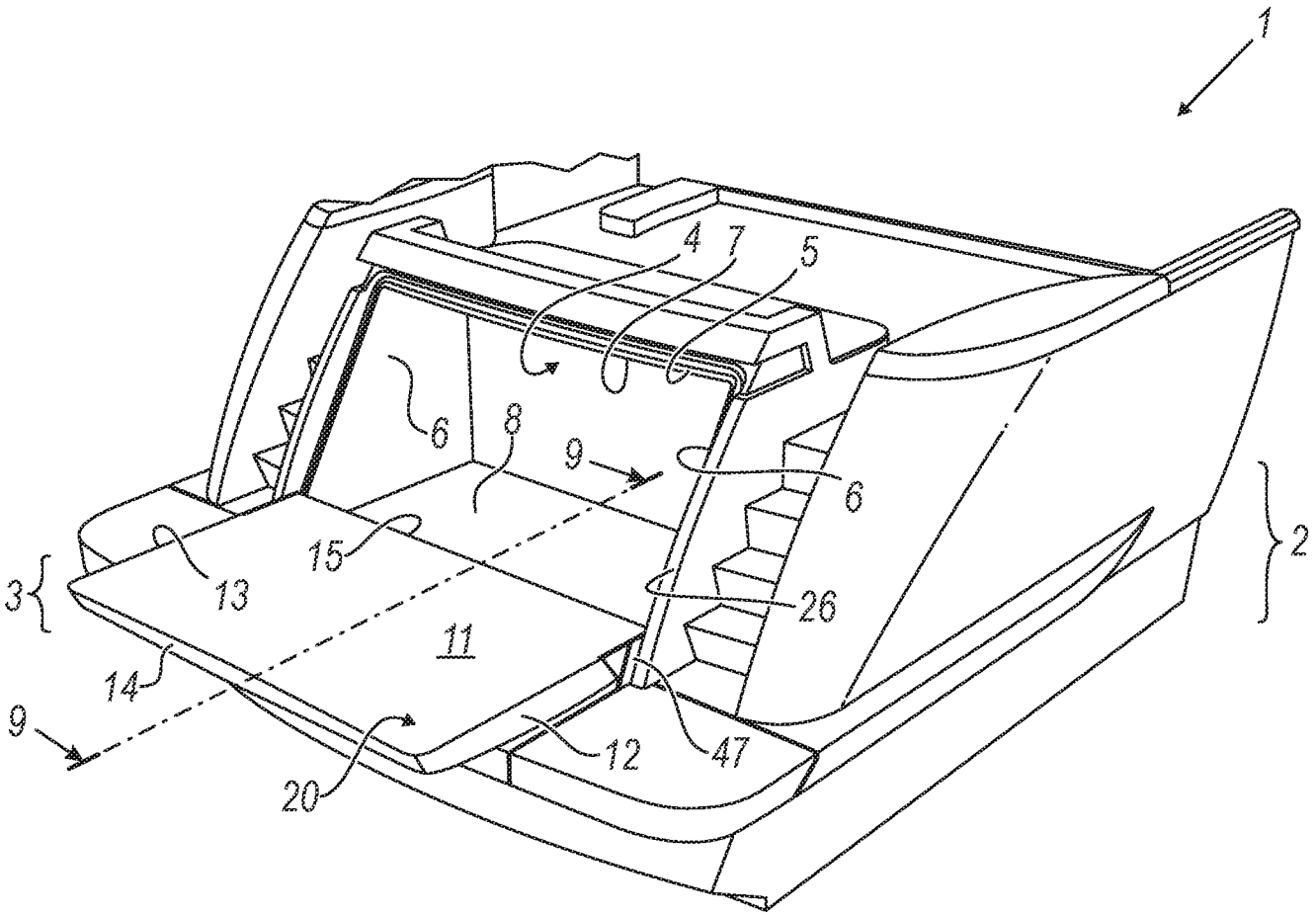
FIG. 2 shows the stern of the boat depicted in FIG. 1, its hatch being open downwards.

With reference to the mentioned figures, a boat 1 is (partially, in its stern portion only) shown as comprising a hull 2 having a stern hatch 3 suitable for enclosing a stern compartment 4, for instance suitable for housing a small boat like a dinghy or a tender (not shown in the figures). Such compartment 4 comprises an aperture 5, opposed side walls 6, an upper part 7, and a lower part 8.

The stern hatch 3 comprises an outer wall 10, an inner wall 11 (generally made of fiberglass, for instance like the hull 2) spaced from each other by sides 12 and 13, upper and lower edges 14 and 15; such walls 10 and 11, said sides 12 and 13, and the upper and lower edges 14 and 15 determine a body 20 of the hatch.

Figure 3:
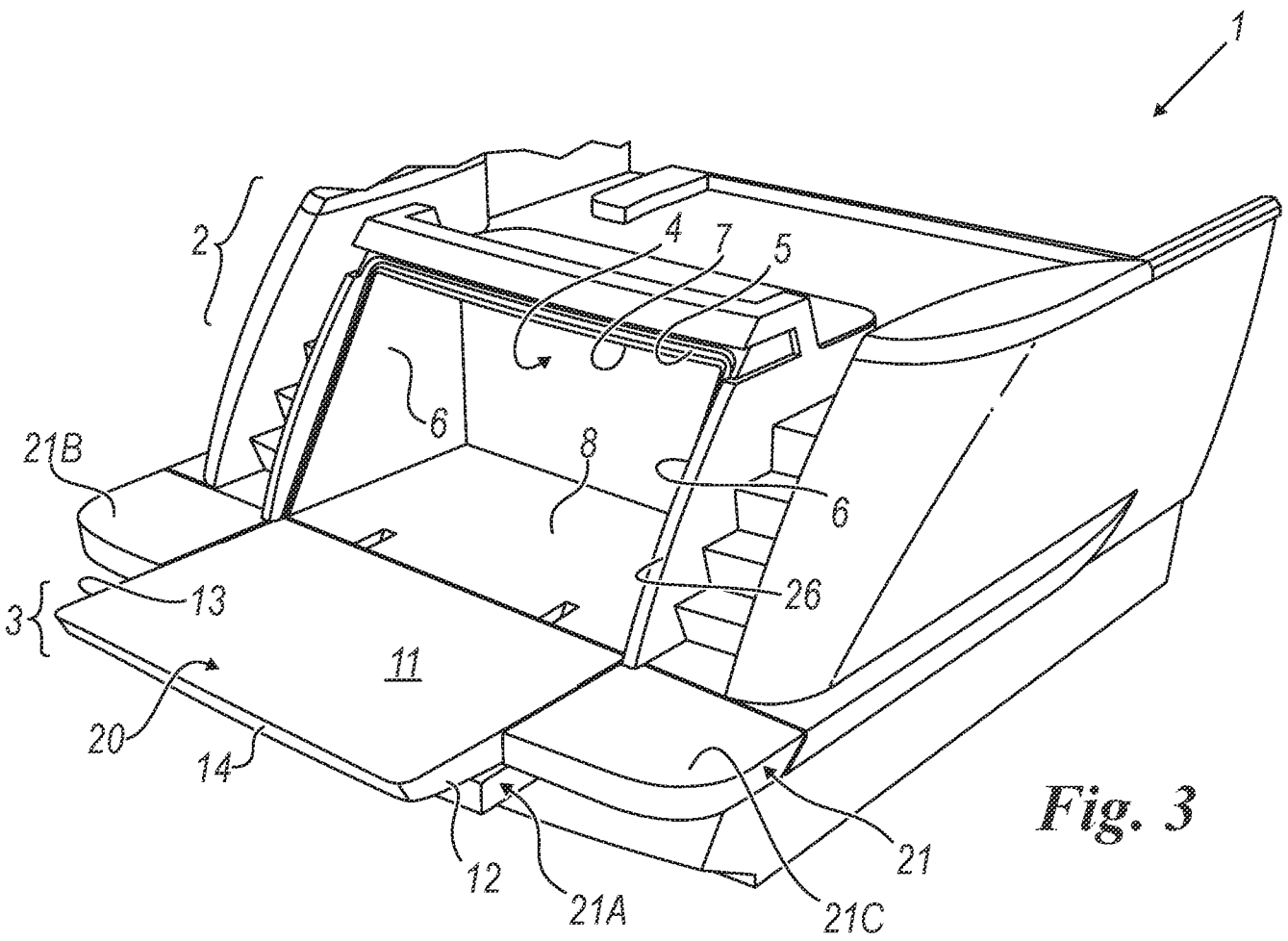
FIG. 3 shows the stern of the boat depicted in FIG. 1, the hatch being further opened downwards.
Figure 4:
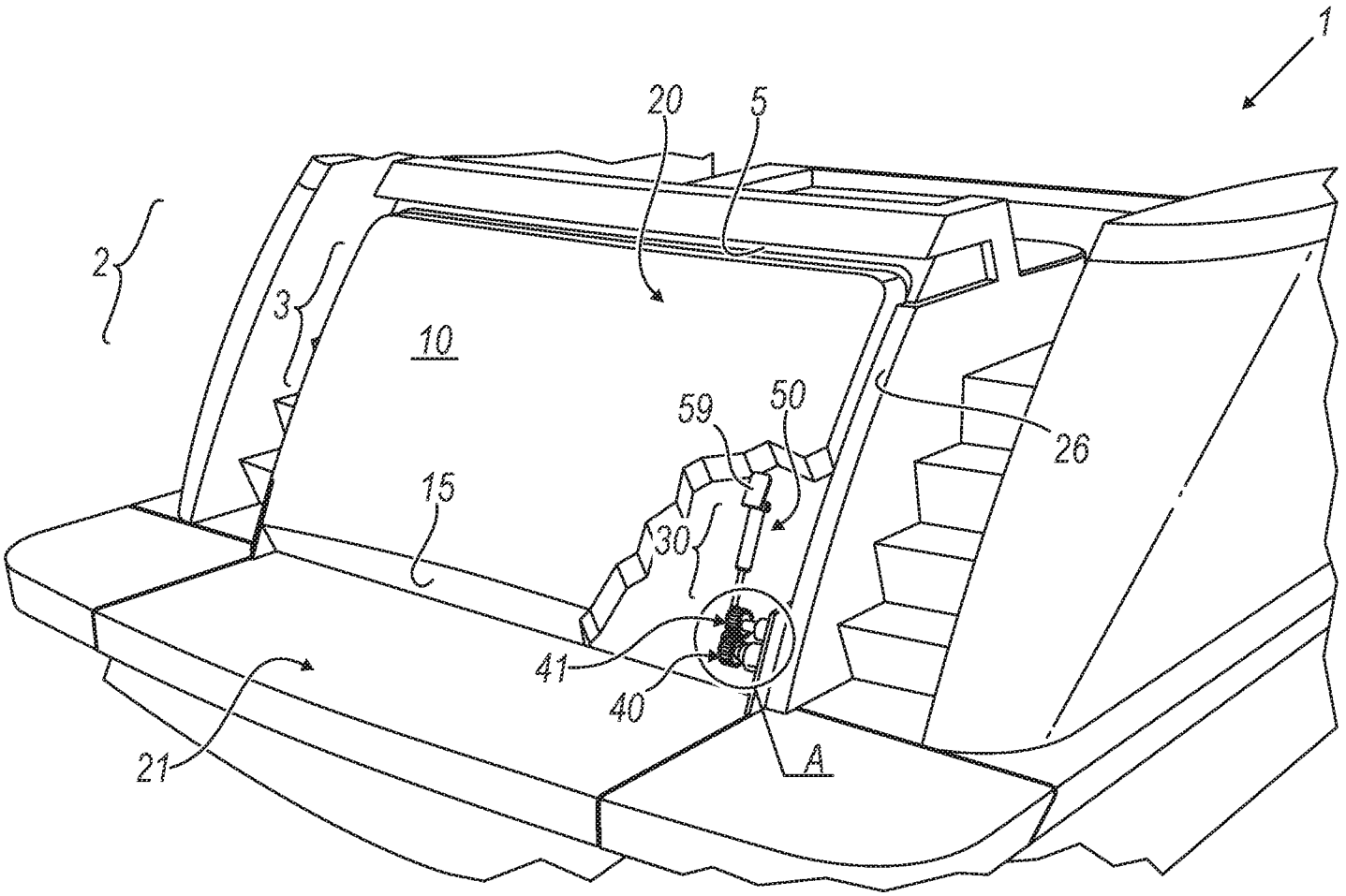
FIG. 4 shows the stern of the boat, the hatch being in the closed position and partially cross-sectioned showing the hatch opening and closing actuating means.
Figure 5:
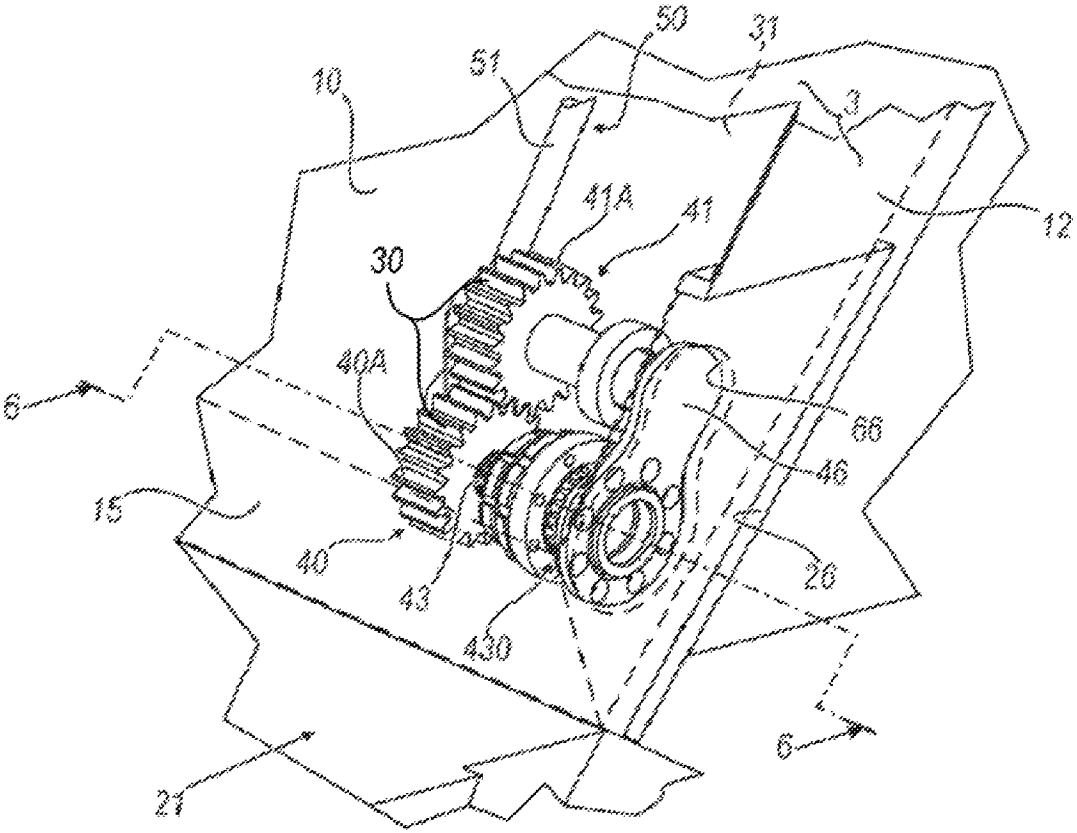
FIG. 5 shows an enlarged, transparent view of the hatch highlighting the detail identified by A in FIG. 4.
Figure 6:
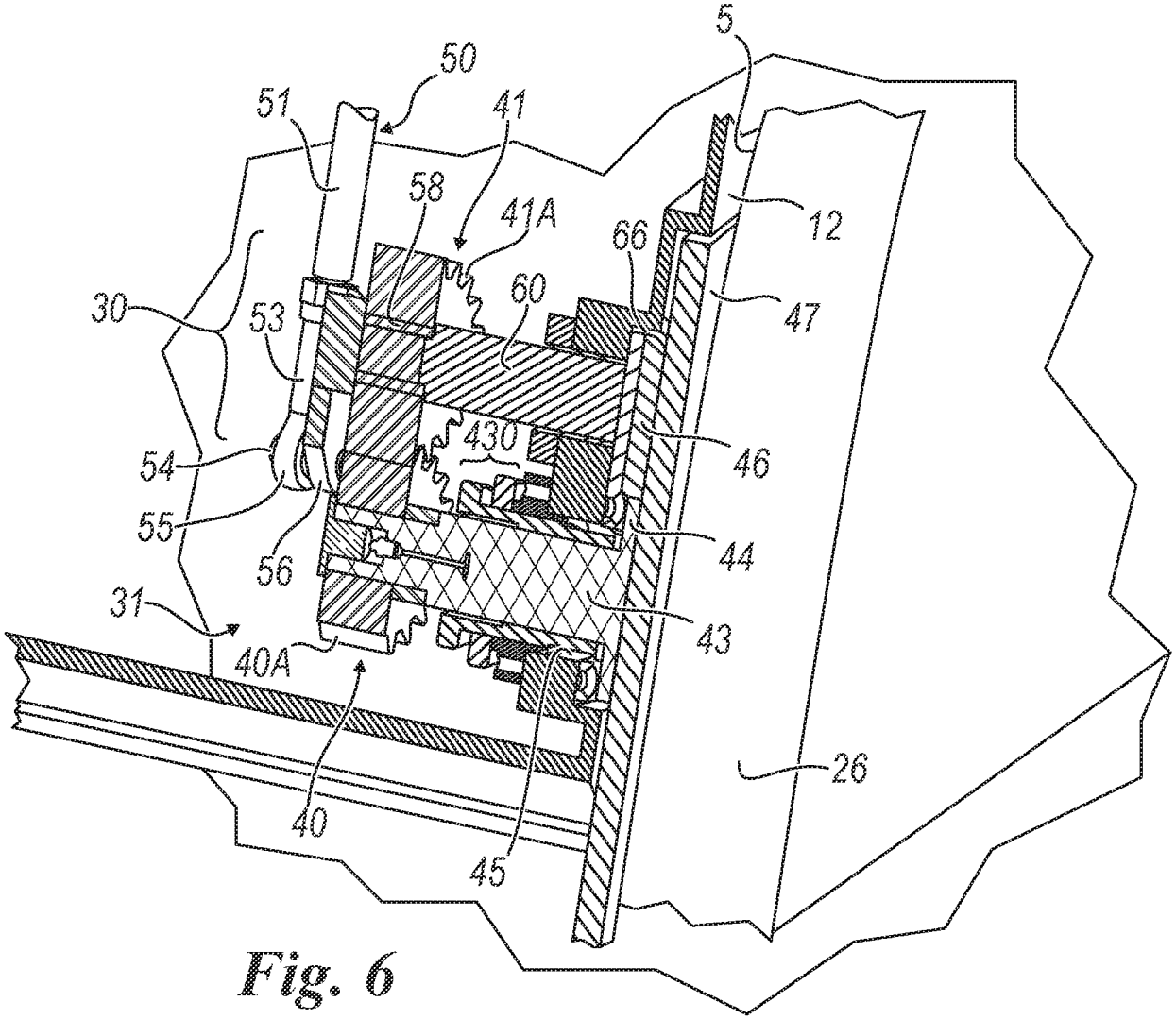
FIG. 6 shows a cross-sectional view according to the line 6-6 of FIG. 5.

In the embodiment depicted in the figures, the hatch 3 is capable of opening toward a stern platform 21 of the hull 2, i.e. it is capable of opening downwards with respect to the compartment 4. Should such platform 21 feature a central portion 21A lowered toward the water (on which the boat floats) with respect to the side portions 21B and 21C, the hatch 3 might reach, when open, a position in which its inner wall 11 is coplanar with the lower wall 8 of the compartment 4, as shown in FIG. 3. Obviously, the same coplanarity can be obtained, the wall 8 being realized in such a way as to fit in with the wall 11, even in the case of a hatch according to FIG. 1.

The outer wall 10 of the hatch is suitable for arranging itself in correspondence with a stern wall 26 of the boat 1 when the hatch is closed, said wall 26 delimiting the aperture 5 of the compartment 4.

According to the invention, the stern hatch 3 is associated with actuating means 30 completely and totally located inside its body 20 only, in a cavity 31 present between the inner wall 11 and the outer one 10; such actuating means 30 make it possible the movement of the hatch with respect to the aperture 5 of the compartment 4 during the opening and closing operations and at the same time constrain said hatch to the latter, so as not to limit the amplitude of said compartment. In this way, the hatch is not provided with any hinge members or further connections to the hull 2. It follows that mainly the side walls 6, but also the walls 7 and 8 of the compartment 4 do not support any hatch actuating member and the hatch is perfectly smooth on all of its side. All of this to the advantage of safety for the people on board the boat 1, who can freely move inside the compartment 4 without any risks of hitting against parts projecting from its walls and also to the advantage of an ease operation in loading means or goods inside such compartment.

For this purpose, in correspondence with at least one side 12, 13 and preferably both of them, should the dimensions and the weight of the hatch be non negligible, the actuating means 30 may be provided within the cavity 31. In the illustrated example, the actuating means 30 comprises a pair of gearings (also known as gear wheels) 40 and 41 whose toothed surfaces 40A and 41A are suitable for cooperating with each other so as to allow a relative movement between said gearings. More specifically, the gearing or gear wheel 40 is fixed to a beveled shaft 43 which is constrained, via an extremal flange 44 arranged in correspondence with a hole 45 present in said side 12, 13, to a support constrained to the craft 2. In particular, such support is a panel 47 which can be connected to the stern wall 26 or its corresponding side wall 6 of the compartment 4; alternatively it can be fixed to the stern platform 21. The beveled shaft 43 is connected to the hatch 3 via other constraint elements, like flanges 430.

The gear wheel 40 is fixed whereas the gear wheel or gearing 41 can move along its toothed surface. Such a movement is generated by a pneumatically, hydraulically, or hydropneumatically powered actuating member 50 and, in the illustrated embodiment, the powered actuating member 50 is telescopic. As illustrated, the powered actuating member 50 may comprise a stem 51 movable in a sleeve 52; the sleeve 52 is fixed, via a support or bracket 59 to a wall, for instance the outer one 10 (from the inside of the cavity 31), of the hatch, whereas the stem 51 features a head 53 supporting a pin 54 (via an eyelet 55) eccentrically fixed or coupled to a body or connecting rod 56 integral with the gearing or gear wheel 41. Activating the powered actuating member 50 results in lowering or lifting the hatch.

Such powered actuating member 50 which is telescopic is controlled by a control unit (not shown in the figures) outside the hatch, indicatively installed in the engine room and which the oil (or air) ducts originate from to subsequently reach the sleeve 52, for instance via the shaft 43 of the first gearing 40.

Such member can be electrically operated indeed.

Figure 7:
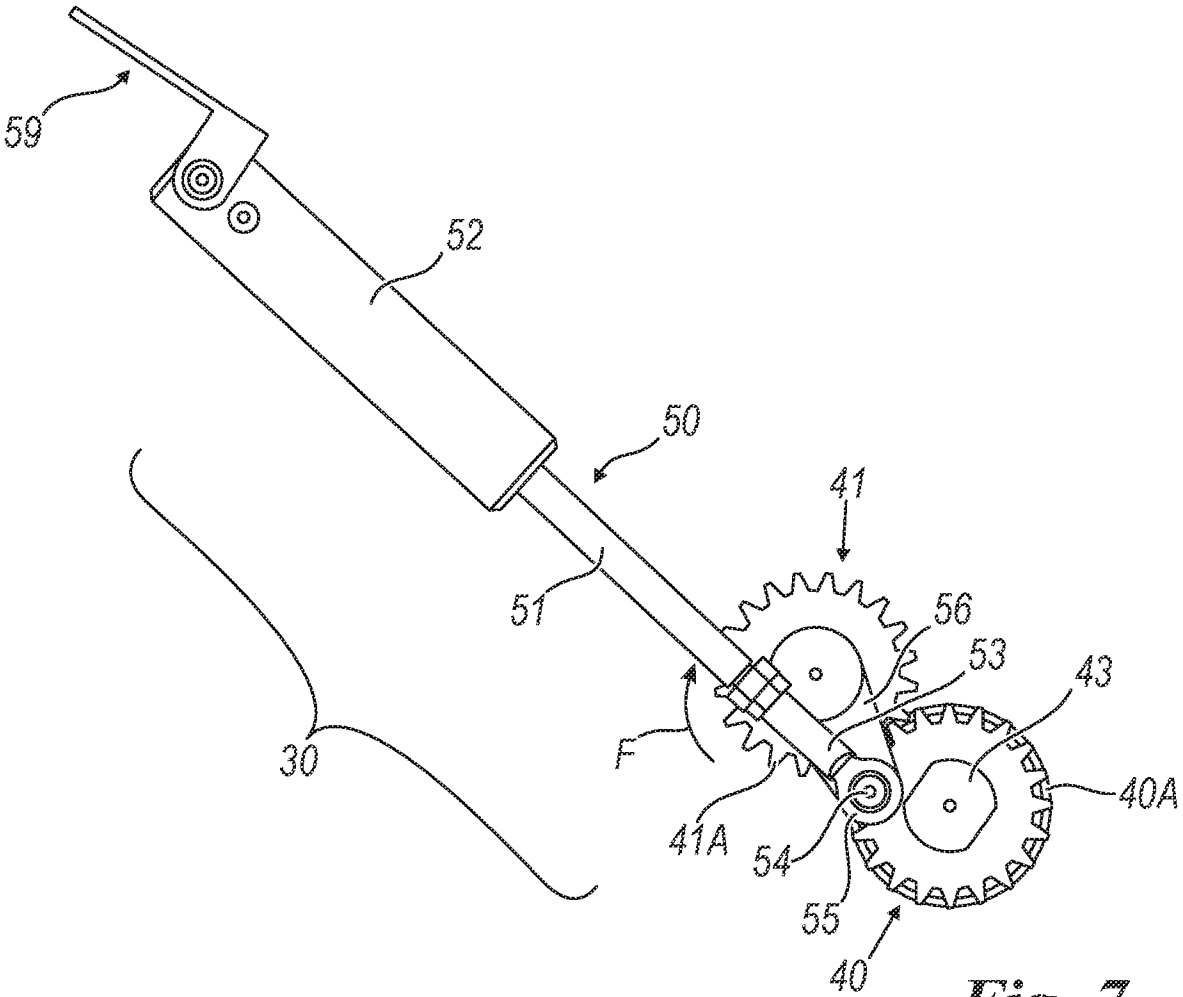
FIG. 7 shows a side view of the hatch actuating means.
Figure 8:
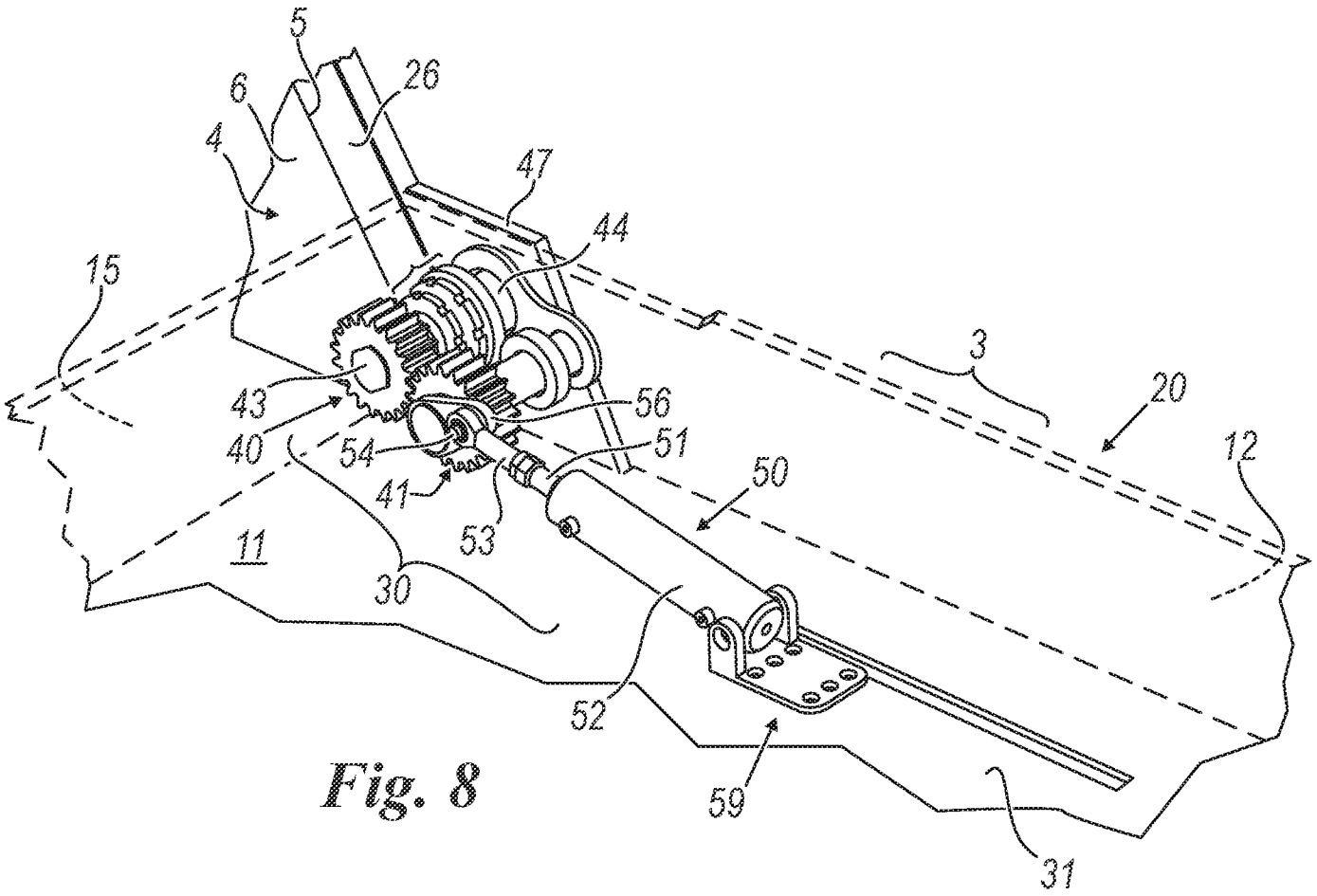
FIG. 8 shows an enlarged, transparent perspective view of the hatch in its open configuration according to FIG. 2.
Figure 9:
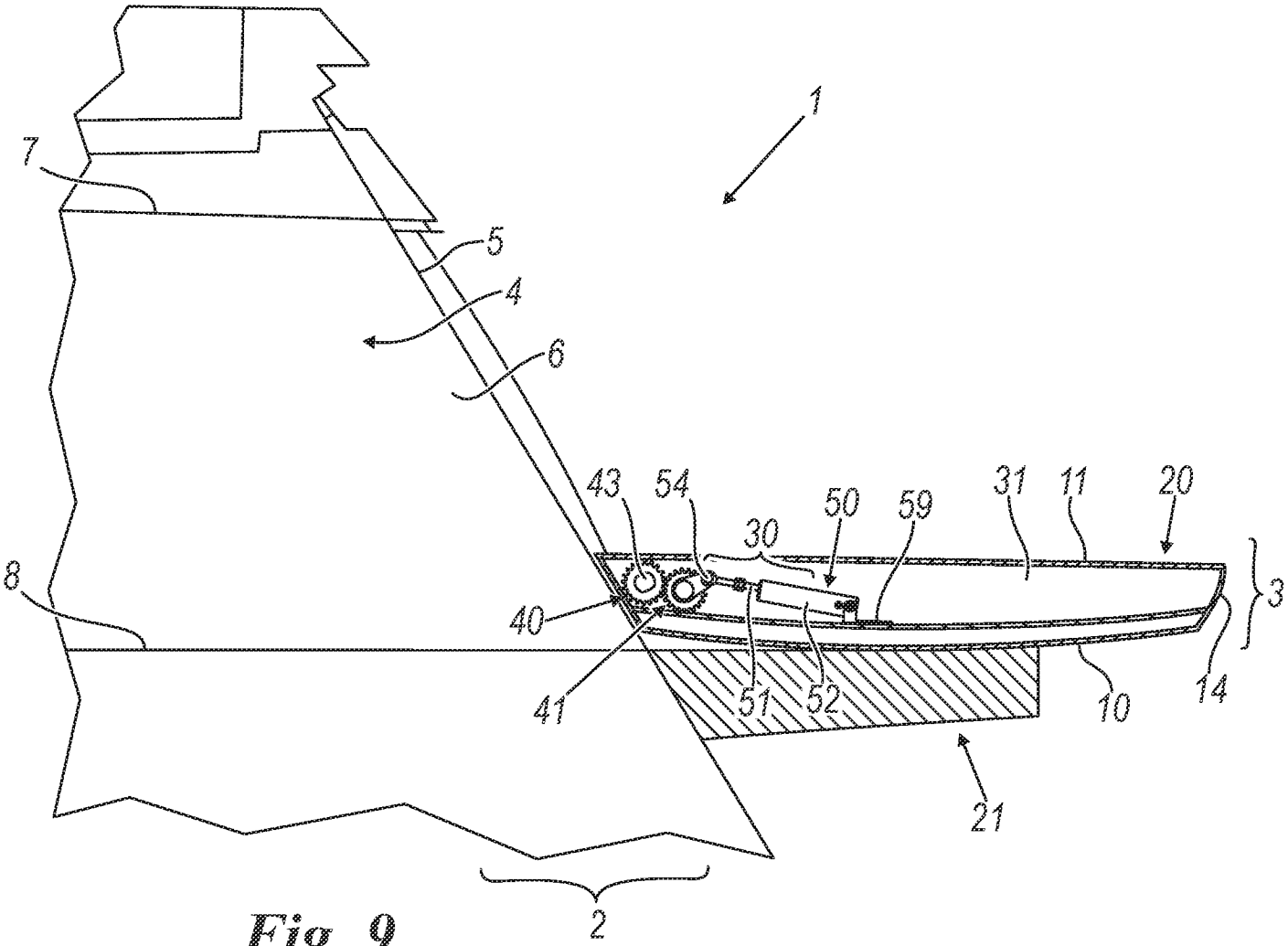
FIG. 9 shows a cross-sectional view according to the line 9-9 of FIG. 2.

More specifically, starting from the position depicted in FIGS. 1 and 7, if the stem 51 is retracted into the sleeve 52, then the connecting rod 56 rotates (clockwise in FIG. 7, see arrow F) the gearing 41 onto the gearing 40, which results in lowering the hatch down. Vice versa, taking the stem 51 out of the sleeve 52 results in a rotation of the gearing 41 onto the gearing 40 that is reversed (with respect to the previous one, i.e. counterclockwise), which results in lifting the hatch 3 up to its closing positioning on the aperture 5 of the compartment 4.

The gearing 41 is rotatable via a bearing or an equivalent member 58 and is put on a shaft 60 projecting from a support 46 and integral therewith. Such support is put on the shaft 43 and can rotate around it thanks to appropriate mechanical decoupling members or bearings.

In particular, such support 46 is located in a hollow 66 created outside the adjacent side 12, 13 of the hatch 3 and is blocked therein by a shape coupling with the hollow itself. In this way, the movement of the gearing 41 on the gearing 40 forces the shaft 60, hence its support 46 and the complete hatch 3, to rotate around such gearing 40, which subsequently operates as a hinge for the hatch.

Thanks to the invention, the possibility is achieved of constraining the hatch to the hull of the boat without using any specially conceived hinge members and at the same time a hatch movement mode is offered which is fully encased therein, which leads to the advantages indicated above. Also, the complete actuating mechanisms defined by the actuating means 30 can be pre-assembled in the hatch and constrained to the panel 47 upon its final mounting on the boat 1. This reduces the mounting time as referred to that necessary with the known solutions. Therefore, the hatch according to the invention is not rigidly connected to the boat.

A specific embodiment of the invention has been described. However, others can be obtained (for instance one that comprises an electric motor, for instance a stepping motor, instead of the powered actuating member 50 which is telescopic) in the light of the previous description and shall be deemed to fall within the scope of the following claims.

The invention claimed is:

1. A boat comprising a hull provided with a rear stern hatch that corresponds with an internal stern compartment of said hull and suitable for opening and closing in correspondence with an aperture of said internal stern compartment, actuating means for opening and closing said rear stern hatch onto said aperture, said rear stern hatch having a body with opposed sides that correspond with side walls of said internal stern compartment and an upper edge and a lower edge, the body of said rear stern hatch comprising a cavity, wherein the actuating means for opening and closing said rear stern hatch located entirely within said cavity of the rear stern hatch, said internal stern compartment being completely free from said actuating means, said actuating means rotatably coupling at least one of said opposed sides of the rear stern hatch to said hull, no other connection of said opposed sides to said hull being provided.

2. A boat according to claim 1, wherein said actuating means comprise a first gearing on which a second gearing, moves, the first gearing being fixed with respect to the hull and functionally connected to the hull, the second gearing being functionally attached to the rear stern hatch.

3. A boat according to claim 2, wherein the second gearing is subjected to a powered actuating member also located in said rear stern hatch.

4. A boat according to claim 3, wherein the second gearing is coupled to a body eccentrically connected to said powered actuating member.

5. A boat according to claim 4, wherein said powered actuating member is located in the cavity of said rear stern hatch.

6. A boat according to claim 5, wherein said powered actuating member a telescopic and comprises a sleeve fixed to the body of said rear stern hatch with respect to which a stem moves having a head eccentrically connected to the body integral with the second gearing.

7. A boat according to claim 6, wherein said powered actuating member is a member selected from the group consisting of a hydraulic actuator, a hydraulic actuator, or a hydropneumatic actuator, or combinations thereof wherein the boat further comprises a control unit that controls pressurized fluid for powering the actuating member, the control unit installed outside the rear stern hatch at a location from where the pressurized fluid originates.

8. A boat according to claim 6, wherein said head of the stem supports a pin eccentrically connected to the body integral with the second gearing.

9. A boat according to claim 6, wherein said powered actuating member is a member selected from the group consisting of a hydraulic actuator, a pneumatic actuator, a hydropneumatic actuator, and an electric actuator, or combinations thereof.

10. A boat according to claim 2, wherein the second gearing is rotatably disposed on a shaft projecting from and integral with a support that is integral with the adjacent side of said rear stern hatch, said support being coupled to a shaft fixedly supporting the first gearing and configured to rotate.

11. A boat according to claim 10, wherein said shaft of the first gearing is fixed to the hull via a supporting member.

12. A boat according to claim 10, wherein said shaft of the first gearing presents an extremal flange attached to a support integral with the hull, said support being alternatively integral with a stern part of the hull or to a stern platform thereof.

13. A boat according to claim 10, wherein the support from which projects the shaft on which rotates the second gearing, is inserted in a shape coupling arrangement in a hollow provided in said side of the rear stern hatch.

14. A boat according to claim 1, wherein said actuating means are configured to be pre-assembled in the rear stern hatch before the rear stern hatch is attached to the hull.

* * * * *